US011172276B2

(12) United States Patent
Lu et al.

(10) Patent No.: US 11,172,276 B2
(45) Date of Patent: Nov. 9, 2021

(54) ANNULAR RADIATION SPEAKER STRUCTURE

(71) Applicants: DEXIN ELECTRONIC LTD., Guangdong (CN); DEXIN CORPORATION, New Taipei (TW)

(72) Inventors: Ho-Lung Lu, New Taipei (TW); Shun-Chieh Chang, New Taipei (TW)

(73) Assignees: DEXIN ELECTRONIC LTD., Guangdong (CN); DEXIN CORPORATION, New Taipei (TW)

( * ) Notice: Subject to any disclaimer, the term of this patent is extended or adjusted under 35 U.S.C. 154(b) by 47 days.

(21) Appl. No.: 16/898,451

(22) Filed: Jun. 11, 2020

(65) Prior Publication Data

US 2021/0258668 A1 Aug. 19, 2021

(30) Foreign Application Priority Data

Feb. 17, 2020 (TW) ..... 109104911

(51) Int. Cl.

| | |
|---|---|
| ***H04R 1/02*** | (2006.01) |
| ***H04R 9/06*** | (2006.01) |
| ***H04R 7/12*** | (2006.01) |
| ***H04R 1/28*** | (2006.01) |

(52) U.S. Cl.

CPC ..... *H04R 1/02* (2013.01); *H04R 1/2834* (2013.01); *H04R 7/12* (2013.01); *H04R 9/06* (2013.01)

(58) Field of Classification Search

CPC ..... H04R 1/02; H04R 1/2834; H04R 7/12; H04R 9/06

USPC ..... 381/160, 386, 328, 380, 337, 349

See application file for complete search history.

(56) References Cited

U.S. PATENT DOCUMENTS

| | | | | |
|---|---|---|---|---|
| 6,031,919 | A * | 2/2000 | Funahashi | H04R 1/2842 181/145 |
| 7,158,648 | B2 | 1/2007 | Butters et al. | |
| 2006/0078136 | A1* | 4/2006 | Stiles | H04R 1/345 381/182 |
| 2020/0296503 | A1* | 9/2020 | Hsu | H04R 1/021 |

* cited by examiner

*Primary Examiner* — Alexander Krzystan
*Assistant Examiner* — Julie X Dang
(74) *Attorney, Agent, or Firm* — Li & Cai Intellectual Property Office

(57) ABSTRACT

An annular radiation speaker structure includes an external speaker enclosure, an internal speaker enclosure and a speaker unit. The external speaker enclosure has a bottom portion and an outer wall, the outer wall extends upward from a periphery of the bottom portion and jointly defines an outer cavity, an inner wall surface of the outer wall has a supporting portion, a height difference between a top end of the supporting portion and a top end of the outer wall is defined as a built-in height, and the bottom portion forms a sound cone. The internal speaker enclosure has an inner cylinder wall, the inner cylinder wall has an upper opening and a lower opening and defines an inner cavity, and a bottom end of the inner cylinder wall is disposed on the supporting portion and forms a resonant cavity between the supporting portion and the sound cone.

10 Claims, 7 Drawing Sheets

ANNULAR RADIATION SPEAKER STRUCTURE

CROSS-REFERENCE TO RELATED PATENT APPLICATION

This application claims the benefit of priority to Taiwan Patent Application No. 109104911, filed on Feb. 17, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an annular radiation speaker structure, in particular to a speaker structure with annular radiation effect.

BACKGROUND OF THE DISCLOSURE

Wireless speakers are gradually gaining popularity. Some applications also require the wireless speakers to have 360-degree sound emitting and receiving effects, for example, the sound emitting and receiving effects of each direction of smart speakers need to be as consistent as possible.

U.S. Pat. No. 7,158,648 discloses a loudspeaker system with an extended bass response, where a speaker unit and an annular passive radiation ring are disposed on the same plane, and a bass effect is produced via a passive radiation ring when the speaker is driven. A disadvantage is that a speaker occupying a large area cannot be used in an area having limited space, thus resulting in sound pressure loss.

Therefore, an important task to be solved in this technical field is to improve an effect of the wireless speakers through an improvement of structural design to overcome the above defects.

SUMMARY OF THE DISCLOSURE

The present disclosure aims to solve technical problems of the conventional technology by providing an annular radiation speaker structure which can increase the sound pressure of the speaker and reduce areas of the speaker to achieve an effect of 360-degree outward sound radiation.

In response to the above-referenced technical inadequacies, the present disclosure provides an annular radiation speaker structure, including: an external speaker enclosure, an internal speaker enclosure, a speaker unit and a passive radiation unit. The external speaker enclosure has a bottom portion and an outer wall, the outer wall extends upward from a periphery of the bottom portion and jointly defines an outer cavity, an inner wall surface of the outer wall has a supporting portion, a height difference between a top end of the supporting portion and a top end of the outer wall is defined as a built-in height, and the bottom portion forms a sound cone. The internal speaker enclosure has an inner cylinder wall, the inner cylinder wall has an upper opening and a lower opening and defines an inner cavity. A bottom end of the inner cylinder wall is disposed on the supporting portion and forms a resonant cavity between the supporting portion and the sound cone. An outer wall of the inner cylinder wall has a plurality of protrusions, and outer ends of the protrusions are close to the inner wall surface of the outer wall. A sound channel is formed between the inner cylinder wall and the outer wall, and a height of the inner cylinder wall is greater than the built-in height. The speaker unit is fixedly arranged on the upper opening of the internal speaker enclosure. An air pressure is generated after the speaker unit is driven, and a resonance is generated via the air pressure passing through the inner cavity and the passive radiation unit, so that a bass radiation radiating downward is generated, the bass radiation being reflected by the sound cone, and the bass radiation being transmitted to a periphery of the external speaker enclosure through the sound channel to form an annular radiation.

Therefore, a beneficial effect of the present disclosure is that the present disclosure provides the annular radiation speaker structure, the passive radiation unit is fixedly arranged on the lower opening of the internal speaker enclosure and faces the sound cone. Therefore, a stacked structure is formed, the stacked structure has advantages of saving space and effectively using the volume of the speaker. The air pressure is generated after the speaker unit is driven, and the resonance is generated via the air pressure passing through the inner cavity and the passive radiation unit, so that the bass radiation radiating downward is generated, the bass radiation being reflected by the sound cone, and the bass radiation being transmitted to the periphery of the external speaker enclosure through the sound channel to form the effect of 360-degree outward sound radiation.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
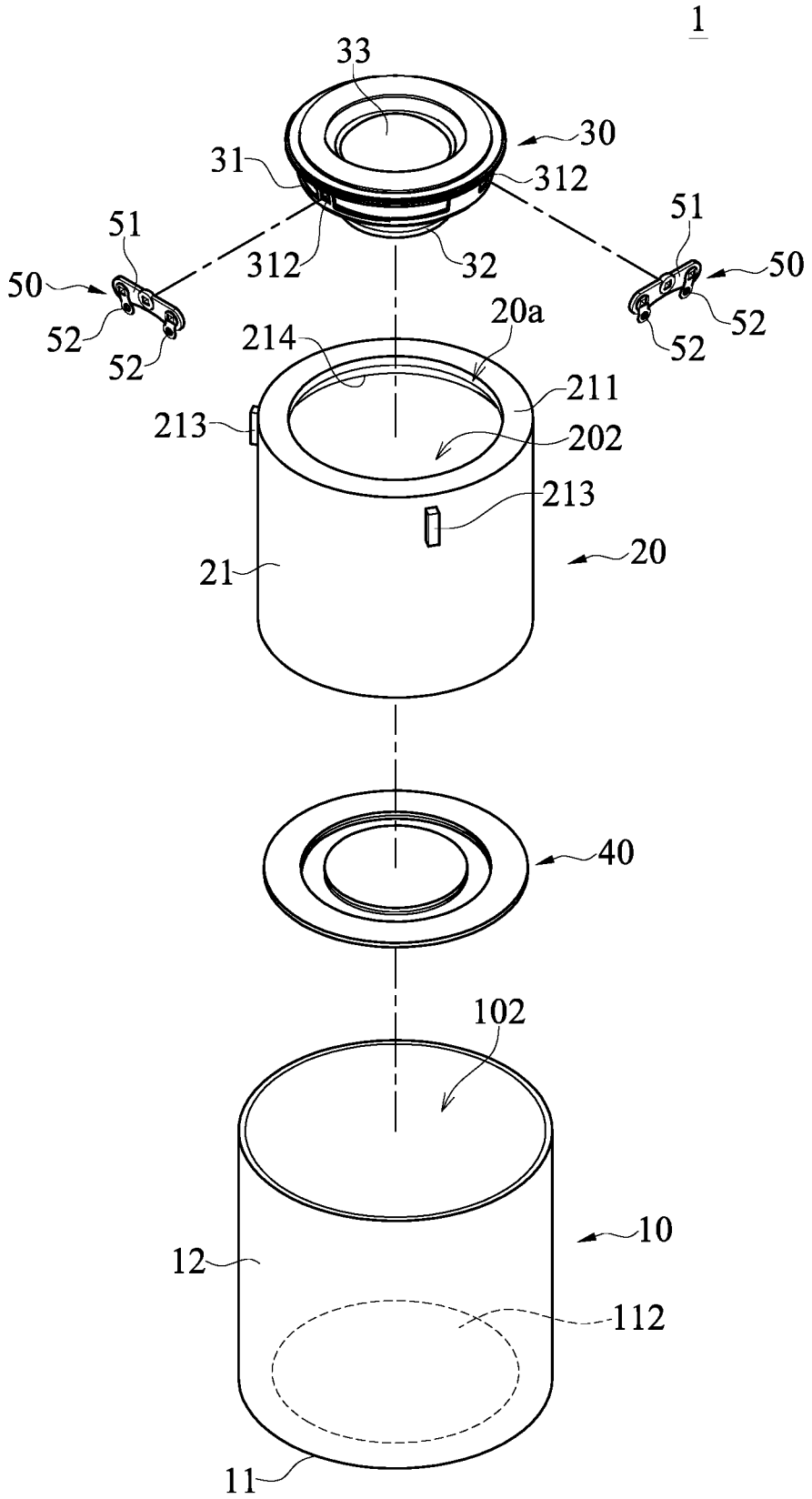
FIG. 1 is an exploded perspective view of an annular radiation speaker structure according a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIGS. 1 to 5, a first embodiment of the present embodiment provides an annular radiation speaker structure 1, including: an external speaker enclosure 10, an internal speaker enclosure 20, a speaker unit 30 and a passive radiation unit 40. The internal speaker enclosure 20 is disposed in the external speaker enclosure 10, and the internal speaker enclosure 20 is slightly exposed and protruded from a top end of the external speaker enclosure 10. The speaker unit 30 is disposed on a top end of the internal speaker enclosure 20. The passive radiation unit 40 is disposed on a bottom end of the internal speaker enclosure 20.

The external speaker enclosure 10 has a bottom portion 11 and an outer wall 12. The outer wall 12 extends upward from a periphery of the bottom portion 11 and jointly defines an outer cavity 102. A height of the outer wall 12 is defined as H1. An inner wall surface of the outer wall 12 has a supporting portion 12S, a height difference between a top end of the supporting portion 12S to a top end of the outer wall 12 is defined as a built-in height H12, and the bottom portion 11 forms a sound cone 112.

Figure 3:
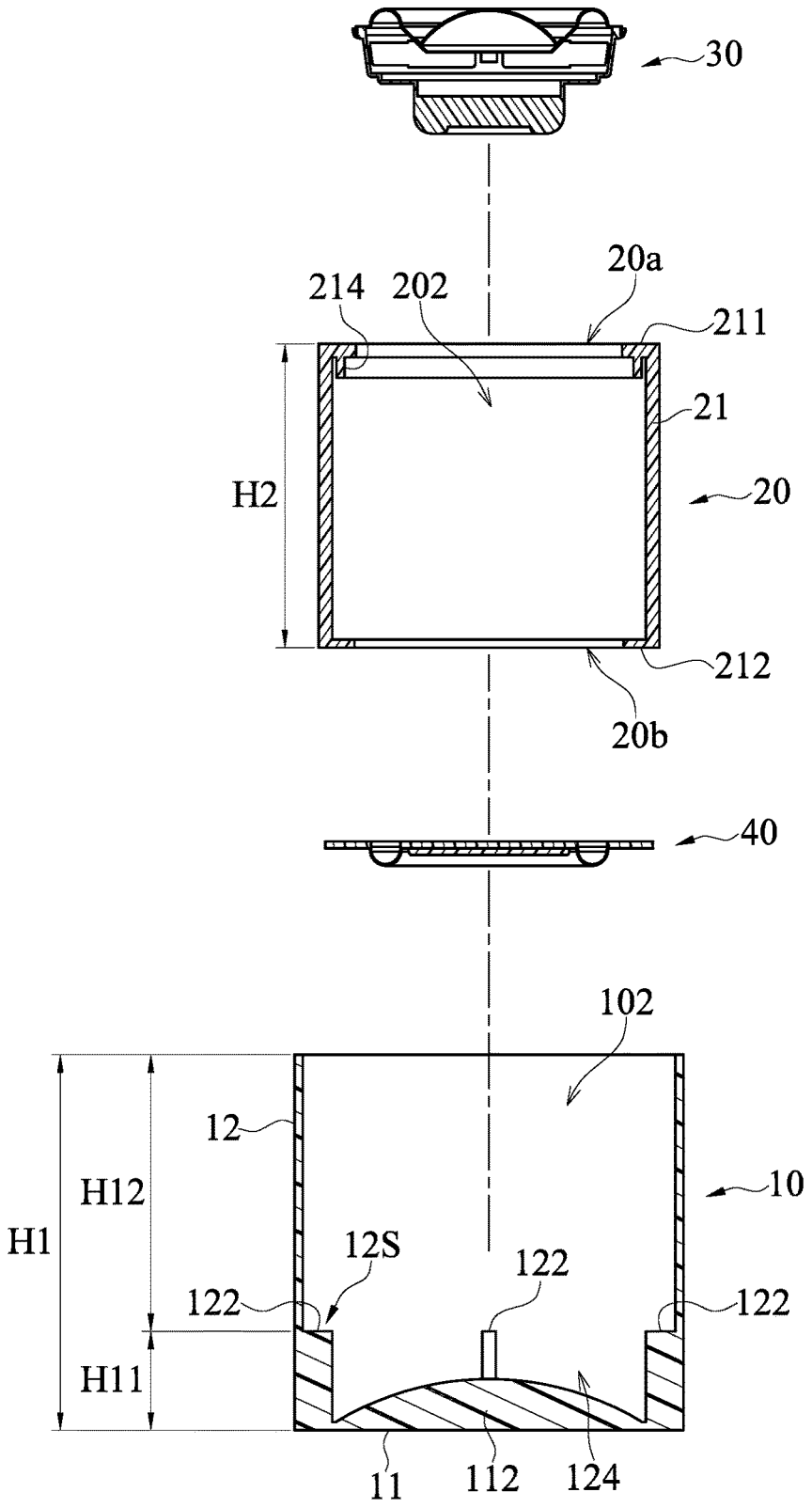
FIG. 3 is an exploded cross-sectional view of the annular radiation speaker structure according the first embodiment of the present disclosure.
Figure 4:
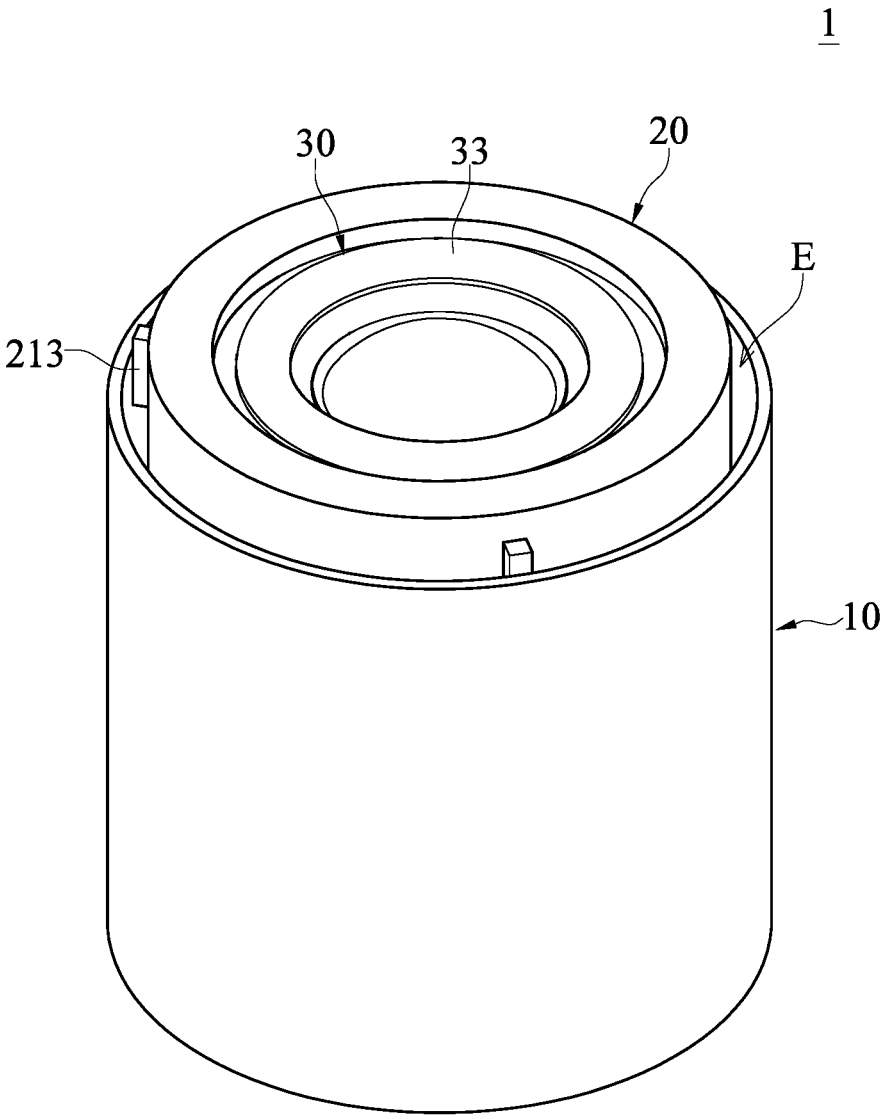
FIG. 4 is an assembled perspective view of the annular radiation speaker structure according the first embodiment of the present disclosure.
Figure 5:
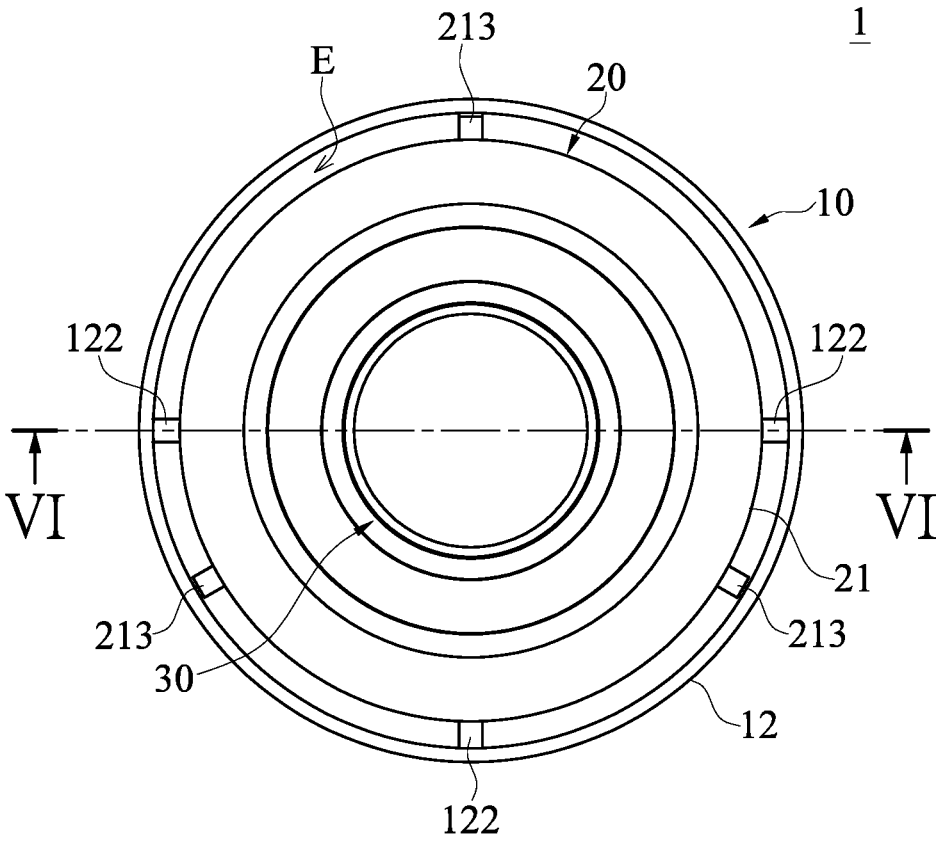
FIG. 5 is a top view of the annular radiation speaker structure according the first embodiment of the present disclosure.

The internal speaker enclosure 20 has an inner cylinder wall 21. The inner cylinder wall 21 has an upper opening 20*a* and a lower opening 20*b* and defines an inner cavity 202. A bottom end of the inner cylinder wall 21 is disposed on the supporting portion 12S and forms a resonant cavity R between the bottom end of the inner cylinder wall 21 and the sound cone 112. An outer wall of the inner cylinder wall 21 has a plurality of protrusions 213, outer ends of the protrusions 213 are close to the inner wall surface of the outer wall 12, and a sound channel E is formed between the inner cylinder wall 21 and the outer wall 12. The sound channel E is cylindrical, and the sound channel E is connected from a bottom portion to a top portion of the external speaker enclosure 10 along a periphery of the internal speaker enclosure 20. Referring to FIG. 3, a height H2 of the inner cylinder wall 21 is greater than the built-in height H12.

The speaker unit 30 is fixedly arranged on the upper opening 20*a* of the internal speaker enclosure 20. The speaker unit 30 of the present embodiment includes a frame 31, an upper diaphragm 33 and an energy conversion member 32. A periphery of the frame 31 is connected to a periphery of the upper opening 20*a* of the internal speaker enclosure 20, the upper diaphragm 33 is exposed from the upper opening 20*a*, a periphery of the upper diaphragm 33 is connected to the periphery of the frame 31, and the energy conversion member 32 is disposed on a bottom of the frame 31 and faces the passive radiation unit 40.

Figure 2:
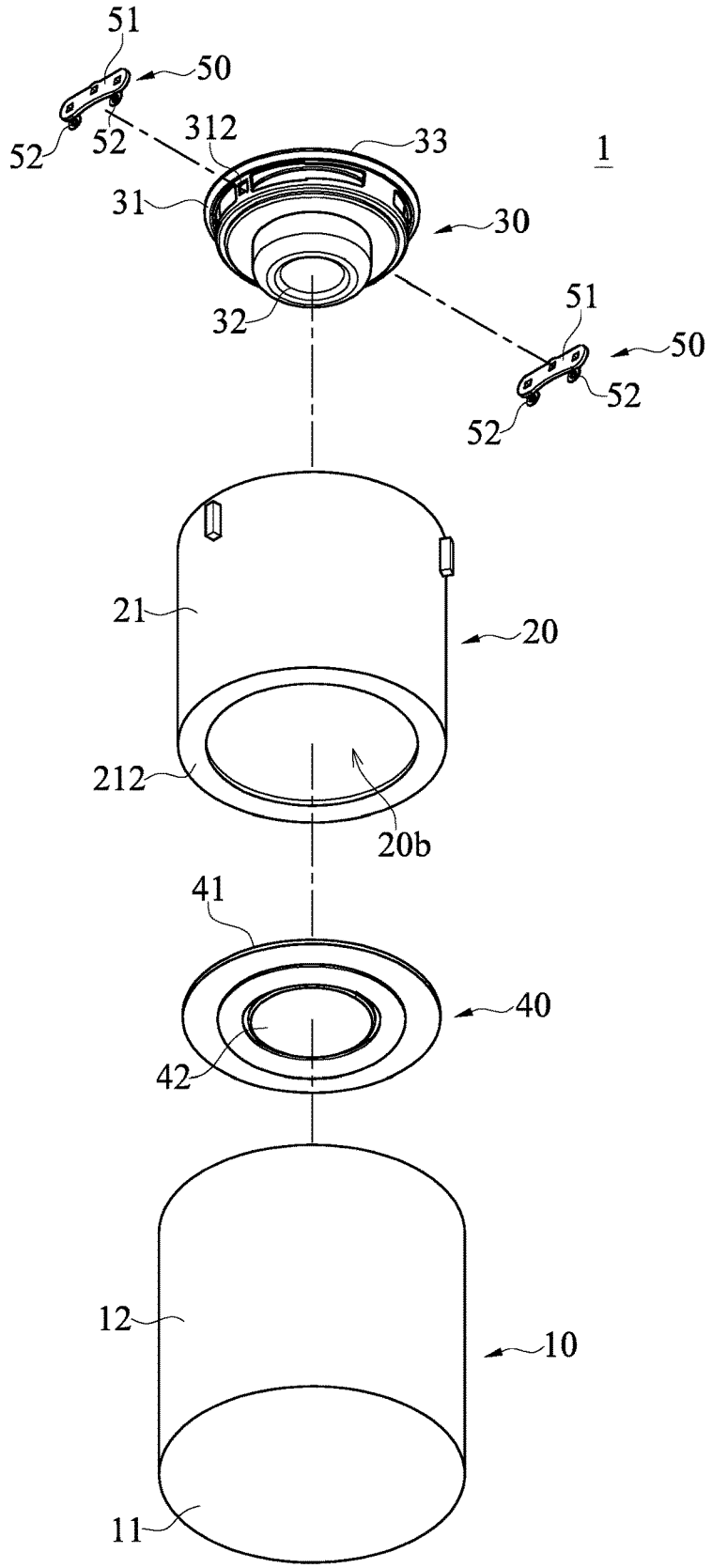
FIG. 2 is another exploded perspective view of the annular radiation speaker structure according the first embodiment of the present disclosure.

Referring to FIGS. 1 to 3, the present embodiment cooperates with the speaker unit 30, the internal speaker enclosure 20 further has a ring-shaped upper flange 211 and a stop ring 214, the upper flange 211 protrudes from a top edge of the inner cylinder wall 21 toward an inside of the upper opening 20*a*, and the stop ring 214 is connected to a bottom surface of the upper flange 211. An inner diameter of the stop ring 214 is greater than an aperture diameter of the upper flange 211. The periphery of the upper diaphragm 33 of the speaker unit 30 is connected to the bottom surface of the upper flange 211.

The above-mentioned speaker unit is for exemplary purposes only, and the speaker unit of the present disclosure is not limited to the above structures or drawings of the present disclosure, any speaker unit that is able to generate a resonance with the passive radiation unit 40 can be applied to the present disclosure. For example, the speaker unit can be an electric speaker unit, a piezoelectric speaker unit or a capacitive speaker unit. In addition, a shape of the upper diaphragm is a dome shape, but the present disclosure is not limited thereto. For example, the upper diaphragm can be a conical diaphragm, a flat diaphragm and a horn diaphragm.

Referring to FIG. 2, in the present embodiment, for fixing the speaker unit 30 to the internal speaker enclosure 20, the annular radiation speaker structure 1 further includes at least a connecting member 50, which fixes the speaker unit 30 to an inner side of the internal speaker enclosure 20. The connecting member 50 includes a main body portion 51 and two extension arms 52, the speaker unit 30 is connected to a middle portion of the main body portion 51, and the two extension arms 52 are respectively connected to two ends of the main body portion 51 and are connected to the internal speaker enclosure 20. In the present embodiment, an upper half of the frame 31 is hollow, and a plurality of joint portions 312 are formed at intervals. The joint portions 312 are connected to the main body portion 51 of the connecting members 50, respectively.

The passive radiation unit 40 is fixedly arranged on the lower opening 20*b* of the internal speaker enclosure 20 and faces the sound cone 112. In the present embodiment, the passive radiation unit 40 includes a passive diaphragm 41 and a weight plate 42, a periphery of the passive diaphragm 41 is connected to a periphery of the lower opening 20*b* of the internal speaker enclosure 20, and the weight plate 42 is disposed at a side of the passive diaphragm 41. The present embodiment cooperates with the passive diaphragm 41 of the passive radiation unit 40, the internal speaker enclosure 20 further has a lower flange 212 which is ring-shaped, the lower flange 212 protrudes from a bottom edge of the inner cylinder wall 21 toward inside of the lower opening 20*b*, and a periphery of the passive diaphragm 41 is adhered to the lower flange 212.

One of the operating characteristics of the present disclosure is that an air pressure is generated after the speaker unit 30 is driven, and a resonance is generated via the air pressure passing through the inner cavity 202 and the passive radiation unit 40, so that a bass radiation radiating downward is generated, the bass radiation being reflected by the sound cone 112, and the bass radiation being transmitted to a periphery of the external speaker enclosure 10 through the sound channel E to achieve an effect of 360-degree outward sound radiation. Accordingly, the present disclosure achieves a goal of 360-degree sound radiation design, where not only a sound is presented in a manner of 360-degree radiation, but also a bass extension is designed with the capability of 360-degree annular radiation.

With particular consideration to the structure of the present disclosure, the inner cavity 202 of the inner speaker 20 and the outer cavity 102 of the external speaker enclosure 10 form a Helmholtz resonance frequency $f_H$. A physical meaning of a sound direction can therefore be regarded as a low-pass filter, which allows low-frequency signals to pass therethrough, but attenuates (or reduces) signals whose frequencies are greater than cutoff frequencies to pass therethrough. In other words, a function of the low-pass filter is achieved and a high sound is reduced via the sound channel E.

More specifically, the frequency designed by the present disclosure must be greater than a resonance frequency produced from the speaker unit 30 and the passive radiation unit 40 being coupled with the internal speaker enclosure 20. Calculations of the Helmholtz resonance frequency $f_H$ of the sound channel E are as below:

a cross-sectional area of the sound channel E is defined as Sp;

a length of the sound channel E along an axis line of the inner cylinder wall is defined as Lp;

an inner volume of the sound channel E is defined as V;

c is a speed of sound; and the Helmholtz resonance frequency $f_H$ formed by the sound channel E is:

$$f_{H=c}/(2\pi)*(Sp/(Lp*V))^{1/2}, \text{ or } f_{H=c}/2\pi\sqrt{(Sp/LpV)}.$$

A coupled resonance frequency is formed after the speaker unit 30 and the passive radiation unit 40 are coupled with the internal speaker enclosure 20, the Helmholtz resonance frequency $f_H$ is greater than the coupled resonance frequency.

Second Embodiment

Figure 6:
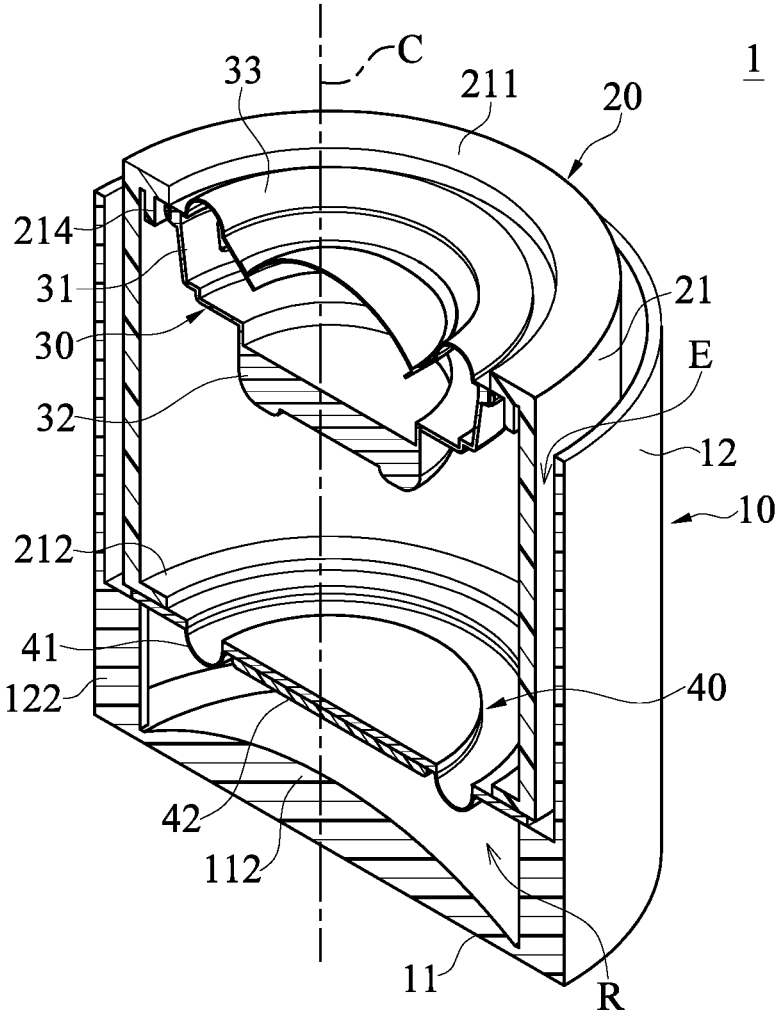
FIG. 6 is a perspective cross-sectional view of the annular radiation speaker structure according a second embodiment of the present disclosure.
Figure 7:
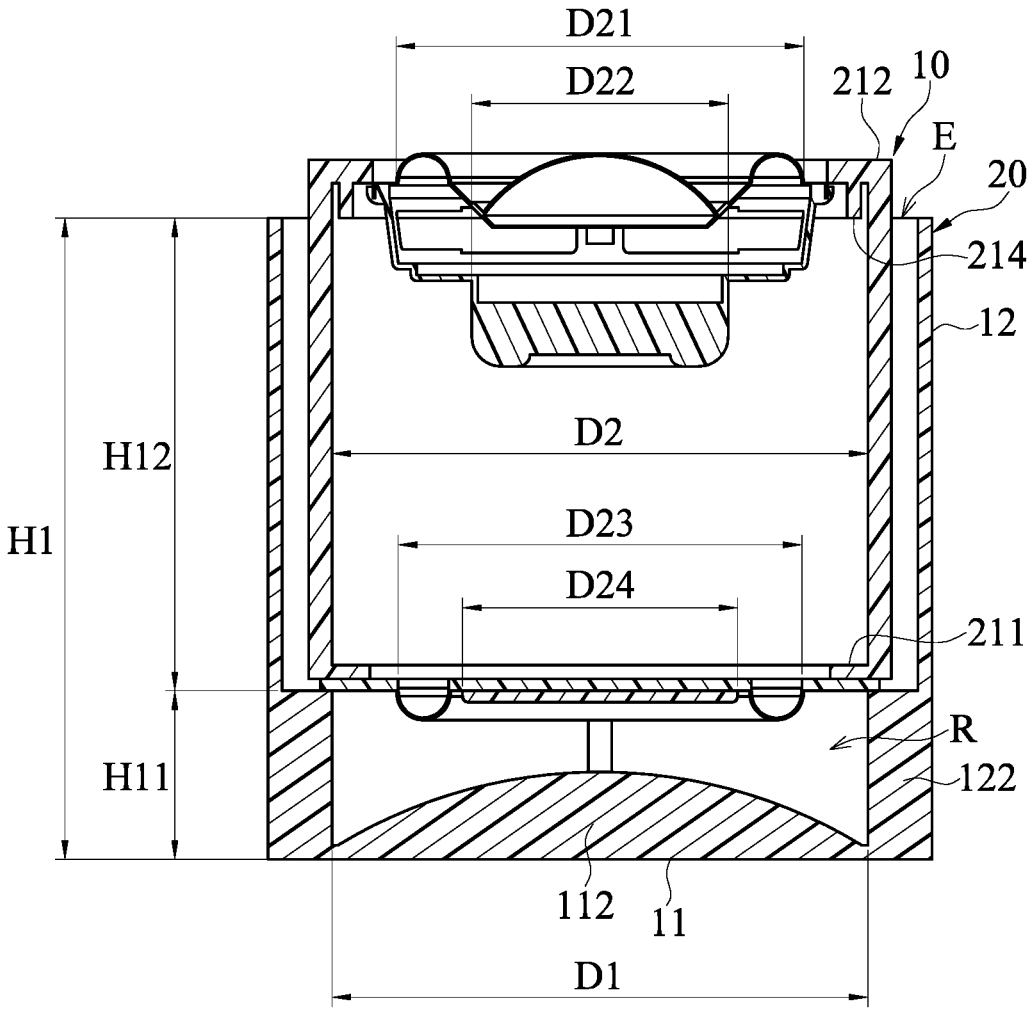
FIG. 7 is a planar cross-sectional view of the annular radiation speaker structure according the second embodiment of the present disclosure.

Referring to FIGS. 6 to 7, the outer cavity 102 of the outer wall 12 is hollow and cylindrical, the inner cylinder wall 21 is cylindrical and defines an axis line C, and an inner diameter D2 of the inner cavity 202 is approximately equal to an outer diameter D1 of the sound cone 112.

The structure in which the external speaker enclosure 10 supports the internal speaker enclosure 20 in the present embodiment is described in detail below. The supporting portion 12S includes a plurality of protruding ribs 122, which are protrudingly disposed on the inner wall surface of the outer wall 12 along a direction parallel to the axis line C of the inner cylinder wall 21, and the protruding ribs 122 form a plurality of gaps 124 between each other.

More specifically, a structural proportion of the present embodiment is described below, but the present disclosure is not limited thereto. A height H11 of the protruding rib 122 is less than the built-in height H12, and a ratio of the built-in height H12 to the height of the protruding rib 122 is 2:1.

The outer diameter D1 of the sound cone 112 is greater than a diameter D24 of the weight plate 42, and the diameter D24 of the weight plate 42 is greater than a diameter D22 of the energy conversion member 32. In addition, a diameter D23 of the passive diaphragm 41 of the passive radiation unit 40 is approximately equal to a diameter D21 of the upper diaphragm 33 of the speaker unit 30.

In conclusion, a beneficial effect of the present disclosure is that the present disclosure provides the annular radiation speaker structure, the passive radiation unit is fixedly arranged on the lower opening of the internal speaker enclosure and faces the sound cone. Therefore, a stacked structure is formed, the stacked structure has advantages of saving space and effectively using a volume of the speaker. An air pressure is generated after the speaker unit is driven, and a resonance is generated via the air pressure passing through the inner cavity and the passive radiation unit, so that a bass radiation radiating downward is generated, the bass radiation being reflected by the sound cone, and the bass radiation being transmitted to the periphery of the external speaker enclosure through the sound channel to form an effect of 360-degree outward sound radiation.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An annular radiation speaker structure, comprising:

an external speaker enclosure having a bottom portion and an outer wall, wherein the outer wall extends upward from a periphery of the bottom portion and jointly defines an outer cavity, an inner wall surface of the outer wall has a supporting portion, a height difference between a top end of the supporting portion and a top end of the outer wall is defined as a built-in height, and the bottom portion forms a sound cone;

an internal speaker enclosure having an inner cylinder wall, wherein the inner cylinder wall has an upper opening and a lower opening and defines an inner cavity, a bottom end of the inner cylinder wall is disposed on the supporting portion and forms a resonant cavity between the bottom end of the inner cylinder wall and the sound cone, an outer wall of the inner cylinder wall has a plurality of protrusions, and outer ends of the protrusions are close to the inner wall surface of the outer wall, a sound channel is formed between the inner cylinder wall and the outer wall, and a height of the inner cylinder wall is greater than the built-in height;

a speaker unit fixedly arranged on the upper opening of the internal speaker enclosure; and a passive radiation unit fixedly arranged on the lower opening of the internal speaker enclosure and facing the sound cone;

wherein an air pressure is generated after the speaker unit is driven, and a resonance is generated via the air pressure passing through the inner cavity and the passive radiation unit, so that a bass radiation radiating downward is generated, the bass radiation being reflected by the sound cone, and the bass radiation being transmitted to a periphery of the external speaker enclosure through the sound channel to form an annular radiation.

2. The annular radiation speaker structure according to claim 1, wherein the outer cavity of the outer wall is hollow and cylindrical, the inner cylinder wall is cylindrical and defines an axis line, and a diameter of the inner cavity is approximately equal to an outer diameter of the sound cone.

3. The annular radiation speaker structure according to claim 2, wherein a cross-sectional area of the sound channel is defined as Sp, a length of the sound channel along the axis line of the inner cylinder wall is defined as Lp, and an inner volume of the sound channel is defined as V, wherein the sound channel forms a resonance frequency in Helmholtz defined as $c/(2\pi)*(Sp/(Lp*V))^{1/2}$, where c representing a speed of sound, a coupled resonance frequency is formed after the speaker unit and the passive radiation unit are coupled with the internal speaker enclosure, and the resonance frequency in Helmholtz is greater than the coupled resonance frequency.

4. The annular radiation speaker structure according to claim 2, wherein the supporting portion includes a plurality of protruding ribs, which are protrudingly disposed on the inner wall surface of the outer wall along a direction parallel to the axis line of the inner cylinder wall, and the protruding ribs form a plurality of gaps between each other.

5. The annular radiation speaker structure according to claim 4, wherein a height of the protruding rib is less than the built-in height, and a ratio of the built-in height to the height of the protruding rib is 2:1.

6. The annular radiation speaker structure according to claim 1, further comprising a connecting member, wherein the connecting member fixes the speaker unit on an inner side of the internal speaker enclosure.

7. The annular radiation speaker structure according to claim 6, wherein the connecting member includes a main body portion and two extension arms, the speaker unit is connected to a middle portion of the main body portion, and the two extension arms are respectively connected to two ends of the main body portion and are connected to the internal speaker enclosure.

8. The annular radiation speaker structure according to claim 1, wherein the speaker unit includes a frame, an upper diaphragm and an energy conversion member, a periphery of the frame is connected to a periphery of the upper opening of the internal speaker enclosure, the upper diaphragm is exposed from the upper opening, a periphery of the upper diaphragm is connected to the periphery of the frame, and the energy conversion member is disposed on a bottom of the frame and faces toward the passive radiation unit.

9. The annular radiation speaker structure according to claim 8, wherein the passive radiation unit includes a passive diaphragm and a weight plate, a periphery of the passive diaphragm is connected to a periphery of the lower opening of the internal speaker enclosure, and the weight plate is disposed at a side of the passive diaphragm.

10. The annular radiation speaker structure according to claim 9, wherein an outer diameter of the sound cone is greater than a diameter of the weight plate, and the diameter of the weight plate is greater than a diameter of the energy conversion member.

* * * * *